US005809815A

United States Patent [19]

Lee

[11] Patent Number: 5,809,815

[45] Date of Patent: Sep. 22, 1998

[54] LEVER LOCK ASSEMBLY WITH A BURGLAR-PROOF EXTERIOR HANDLE

[75] Inventor: Chih-Hsing Lee, Kangshan, Taiwan

[73] Assignee: Taiwan Fu Hsing, Kaohsuing County, Taiwan

[21] Appl. No.: 691,676

[22] Filed: Aug. 29, 1996

[51] Int. Cl.[6] ..... E05B 13/10

[52] U.S. Cl. ..... 70/472; 70/149; 70/223; 70/224

[58] Field of Search ..... 70/224, 472, 422, 70/149, 218, 221–223; 292/DIG. 27

[56] References Cited

U.S. PATENT DOCUMENTS

| | | | |
|---|---|---|---|
| 2,642,735 | 6/1953 | Quigley | 70/380 |
| 2,998,274 | 8/1961 | Russell | 70/468 X |
| 3,079,189 | 2/1963 | Russell et al. | 292/336.3 |
| 3,955,387 | 5/1976 | Best et al. | 70/224 |
| 4,424,691 | 1/1984 | Foshee | 70/416 X |
| 4,428,212 | 1/1984 | Best et al. | 70/224 |
| 4,465,311 | 8/1984 | Austin | 292/336.3 X |
| 5,421,178 | 6/1995 | Hamel et al. | 70/283 |

*Primary Examiner*—Lloyd A. Gall
*Attorney, Agent, or Firm*—Bacon & Thomas

[57] ABSTRACT

A lever lock assembly includes an interior handle assembly, an exterior handle assembly, a latch assembly, and a controlling assembly. When in a latched position, rotation of an exterior lever of the exterior handle assembly is a free rotation, thereby avoiding forcible unlatching by burglars.

3 Claims, 6 Drawing Sheets

LEVER LOCK ASSEMBLY WITH A BURGLAR-PROOF EXTERIOR HANDLE

BACKGROUND OF THE INVENTION

1. Field of the Invention

The present invention relates to a lever lock assembly with a burglar-proof exterior handle and, more particularly, to a lever lock assembly which cannot be forcibly unlatched by applying a relatively large force to the exterior handle thereof.

2. Description of the Related Art.

A lever lock assembly generally includes an exterior handle which cannot be rotated after being locked. However, a burglar still can apply a relatively large force to the exterior handle and thus forcibly unlatch the lock assembly. The present invention is intended to provide an improved lever lock assembly which solves this problem.

SUMMARY OF THE INVENTION

It is an object of the present invention to provide an improved lever lock assembly having an exterior handle which is movable responsive to an external force applied thereto, thereby preventing unauthorized forcible unlatching of the lever lock assembly.

In accordance with the present invention, a lever lock assembly comprises an exterior handle, an interior handle, a latch assembly, and a controlling assembly. The interior handle assembly comprises an interior handle with an interior lever, an interior spindle attached to the interior handle to rotate therewith, a press button, and a safety bar having a first end connected to and actuatable by the press button and a second end. The exterior handle assembly includes an exterior handle with an exterior lever, an exterior spindle attached to the exterior handle to rotate therewith, and a lock core assembly mounted in the exterior handle and having a tail piece.

The latch assembly is securely mounted to an interior side of a door to which the lever lock assembly is mounted. The latch assembly includes an actuator adapted to cause movement of a dead bolt for locking and unlocking the door, wherein the safety bar engages with the actuator when in a latched position upon depression of the press button, and the safety bar disengages from the actuator when in an unlatched position.

The controlling assembly is mounted in the interior handle and comprises a barrel received in the exterior spindle and including two ears projecting outwardly therefrom, the ears causing the safety bar to disengage from the actuator when the barrel is rotated, thereby achieving an unlatching function. The barrel further includes a hole defined in an end wall thereof through which the tail piece of the lock core assembly extends.

An inner shaft is received in the barrel and includes a first end for engaging with the tail piece of the lock core assembly and a second end. An elastic member is received in the barrel for biasing the inner shaft to engage with the second end of the safety bar and biasing the inner shaft to engage with the barrel to rotate therewith. A movable plate is mounted to the second end of the inner shaft to move therewith along a longitudinal direction of the barrel. The movable plate is freely rotatable about the second end of the inner shaft. The movable plate engages with the barrel to rotate therewith when in the unlatched position. When in the latched position upon depression of the press button, the movable plate is freely rotatable about the exterior spindle, whereby rotation of the exterior handle causes free rotation of the movable plate such that the barrel is not rotated.

Preferably, the barrel further includes a triangular slot having an end edge, and the inner shaft includes a pin projecting therefrom and releasably received in the end edge of the triangular slot to rotate therewith when in the unlatched position.

When a proper key is inserted into the lock core assembly, the lock core assembly is rotated through an angle greater than a maximum rotational travel angle of the exterior handle.

In a preferred embodiment of the invention, the exterior handle includes a first longitudinal slot defined in a periphery thereof and a transverse slot defined in the periphery thereof and intersected with the first longitudinal slot. The barrel further includes a second longitudinal slot defined in a periphery thereof, while the movable plate includes a protrusion extending beyond the second longitudinal slot and slidably received in the first longitudinal slot of the exterior handle. When in the latched position, the protrusion of the movable plate is located in and thus freely rotatable in an intersection of the first longitudinal slot and the transverse slot.

The second end of the inner shaft may include an annular groove defined therein, and the movable plate is freely rotatably retained in the annular groove of the second end of the inner shaft.

Other objects, advantages, and novel features of the invention will become more apparent from the following detailed description when taken in conjunction with the accompanying drawings.

DESCRIPTION OF THE PREFERRED EMBODIMENT

Figure 1:
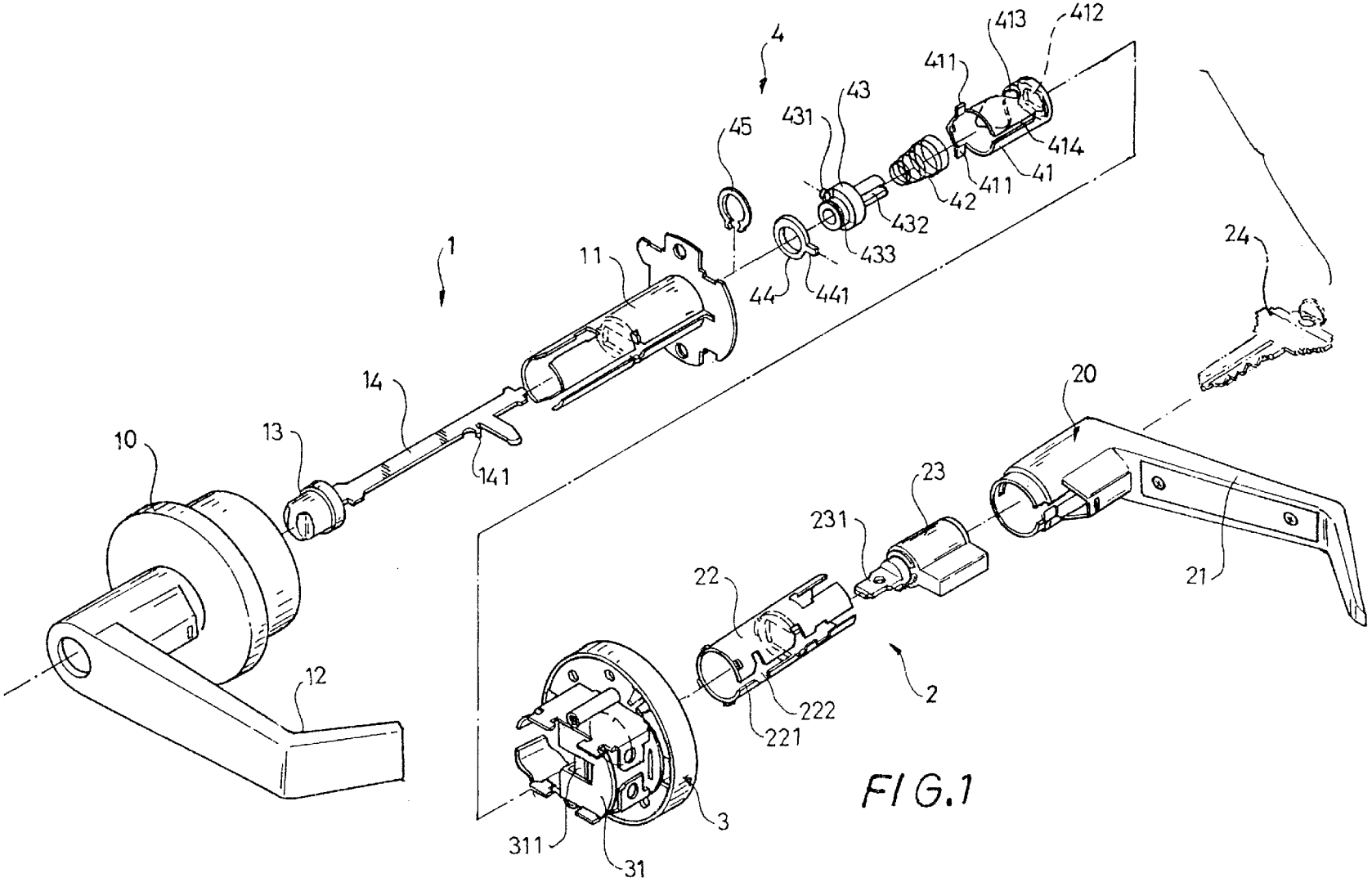
FIG. 1 is an exploded perspective view of a lever lock assembly in accordance with the present invention.
Figure 2:
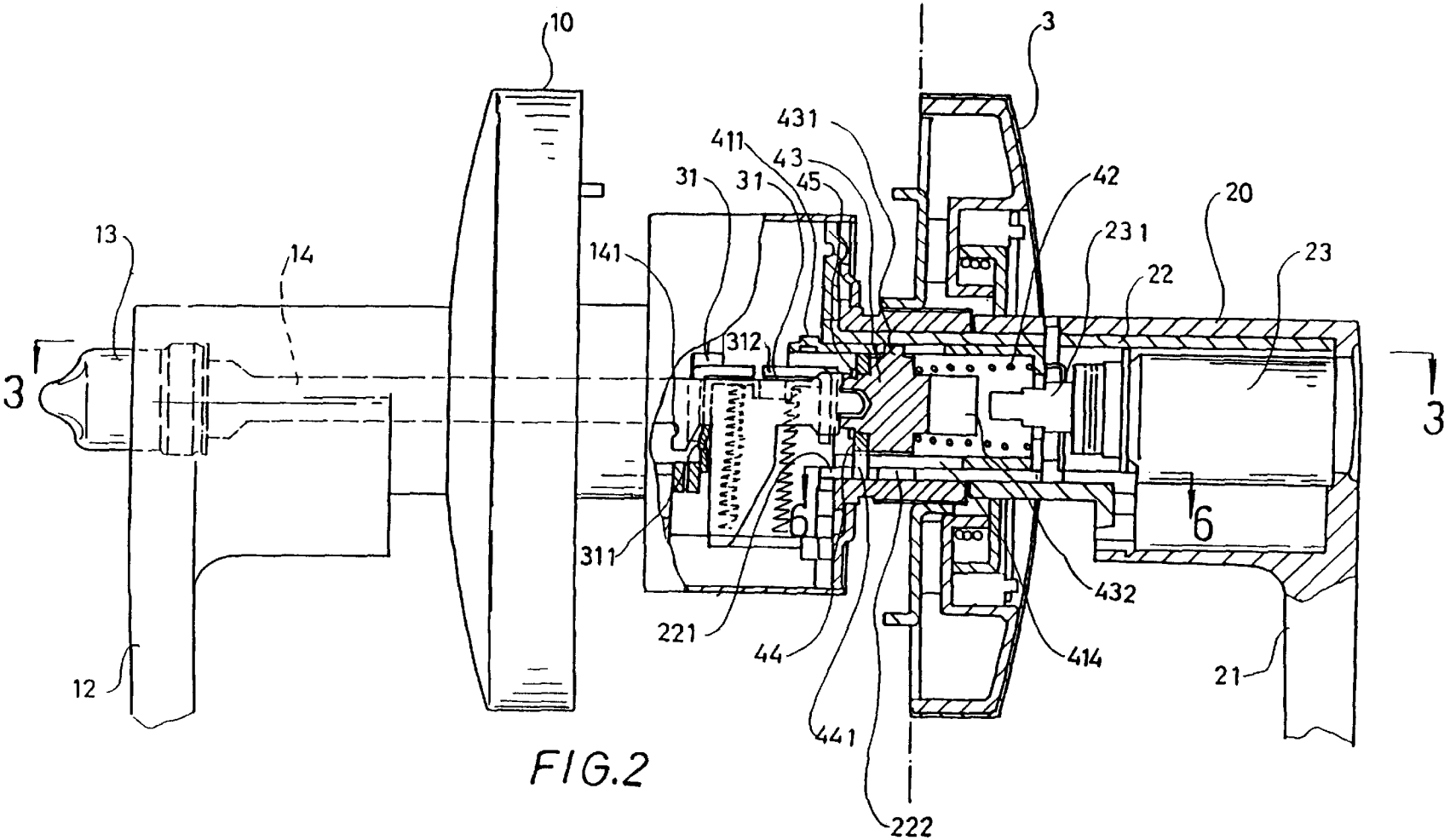
FIG. 2 is a partially sectioned side elevational view of the lever lock assembly in accordance with the present invention.

Referring to the drawings and initially to FIGS. 1 and 2, a lever lock assembly in accordance with the present invention generally includes an interior handle assembly 1, an exterior handle assembly 2, a latch assembly 3, and a controlling assembly 4.

The interior handle assembly 1 includes an interior handle 10 with a lever 12, an interior spindle 11 attached to the interior handle 10 to rotate therewith, a safety bar 14, and a press button 13. The press button 13, when pressed, may urge the safety bar 14 to move longitudinally, while the safety bar 14 has a hook 141 releasably received in a notch 311 defined in an actuator 31 of the latch assembly 3, thereby achieving the required latching function.

The exterior handle assembly 2 includes an exterior handle 20 with a lever 21, an exterior spindle 22 attached to the exterior handle 20 to rotate therewith, and a lock core assembly 23 which is mounted in the exterior handle 20 and which can be operated by a proper key 24 to cause rotation of a tail piece 231 of the lock core assembly 23. The controlling assembly 4 is mounted in the exterior spindle 22, which will be described hereinafter.

The latch assembly 3 is securely mounted to an interior side of a door to which the lever lock assembly is mounted. Extraction movement of the actuator 31 causes a dead bolt (not shown) of the lever lock assembly to disengage from a cavity (not shown) defined in a door jamb (not shown), thereby achieving the unlatching function, which is conventional and therefore not further described. When the hook 141 of the safety bar 14 is received in the notch 311 of the actuator 31, the actuator 31 is in a locked status, i.e., the actuator 31 cannot be moved.

The controlling assembly 4 includes a barrel 41, an elastic member 42, an inner shaft 43, and a movable plate 44. The barrel 41 is received in an end of the exterior spindle 22 and includes two ears 411 projecting outwardly therefrom. When the barrel 41 is rotated, the ears 411 will press against wall 312 of the actuator 31 to compress the actuator 31 to cause the hook 141 of the safety bar 14 to disengage from the notch 311 of the actuator 31, thereby achieving the unlatching function.

The elastic member 42, the inner shaft 43, and the movable plate 44 are mounted in the barrel 41. The barrel 41 further includes a hole 412 defined in an end wall thereof. The tail piece 231 of the lock core assembly 23 extends through the end wall of the barrel 41. The barrel 41 further includes a substantially triangular slot 413 and a longitudinal slot 414 defined in a peripheral wall thereof. The inner shaft 43 includes a pin 431 projecting therefrom and extending beyond the triangular slot 413, while the triangular slot 413 includes an end edge 4131 which provides a reliable engagement with the pin 431, thereby allowing rotational movements of the barrel 41 and the inner shaft 43. The movable plate 44 includes a protrusion 441 which is received in the longitudinal slot 414 of the barrel 41 such that the barrel 41 and the movable plate 44 may rotate together.

The elastic member 42 received in the barrel 41 includes a first end attached to the end wall of the barrel 41 and a second end mounted around a first reduced end of the inner shaft 43. The elastic member 42 biases the inner shaft 43 away from the end wall of the barrel 41 such that the inner shaft 43 always bears against the safety bar 14 and that the pin 431 is securely retained in the triangular slot 413.

The pin 431 of the inner shaft 43 is either located in the end edge 4131 of the triangular slot 413 or in a straight section 4132 of the triangular slot 413. The first reduced end of the inner shaft 43 includes a longitudinal slot 432 for receiving the tail piece 231 of the lock core assembly 23. The movable plate 44 is mounted to a second end of the inner shaft 43 in which an annular groove 433 is defined in the second end of the inner shaft 43 and a C-clamp 45 is provided for retaining the movable plate 44 in position yet allowing free rotation of the movable plate 44 relative to the inner shaft 43. The inner shaft 43 bears against an end of the safety bar 14, while the other end of the safety bar 14 is connected to the press button 13 such that when the press button 13 is pressed, the safety bar 14 is urged to move toward the exterior handle 20, which, in turn, causes the inner shaft 43 to move toward the exterior handle 20.

The protrusion 441 of the movable plate 44 extends beyond the longitudinal slot 414 of the barrel 41 and is slidably received in a longitudinal slot 221 of the exterior spindle 22. More particularly, the protrusion 441 of the movable plate 44 may be moved along the slot 221 to a transverse slot 222 which is defined in the exterior spindle 22 and which intersects with the longitudinal slot 221. The movable plate 44 is freely rotatable when the protrusion 441 is in an intersection of the transverse slot 222 and the longitudinal slot 221.

Figure 3:
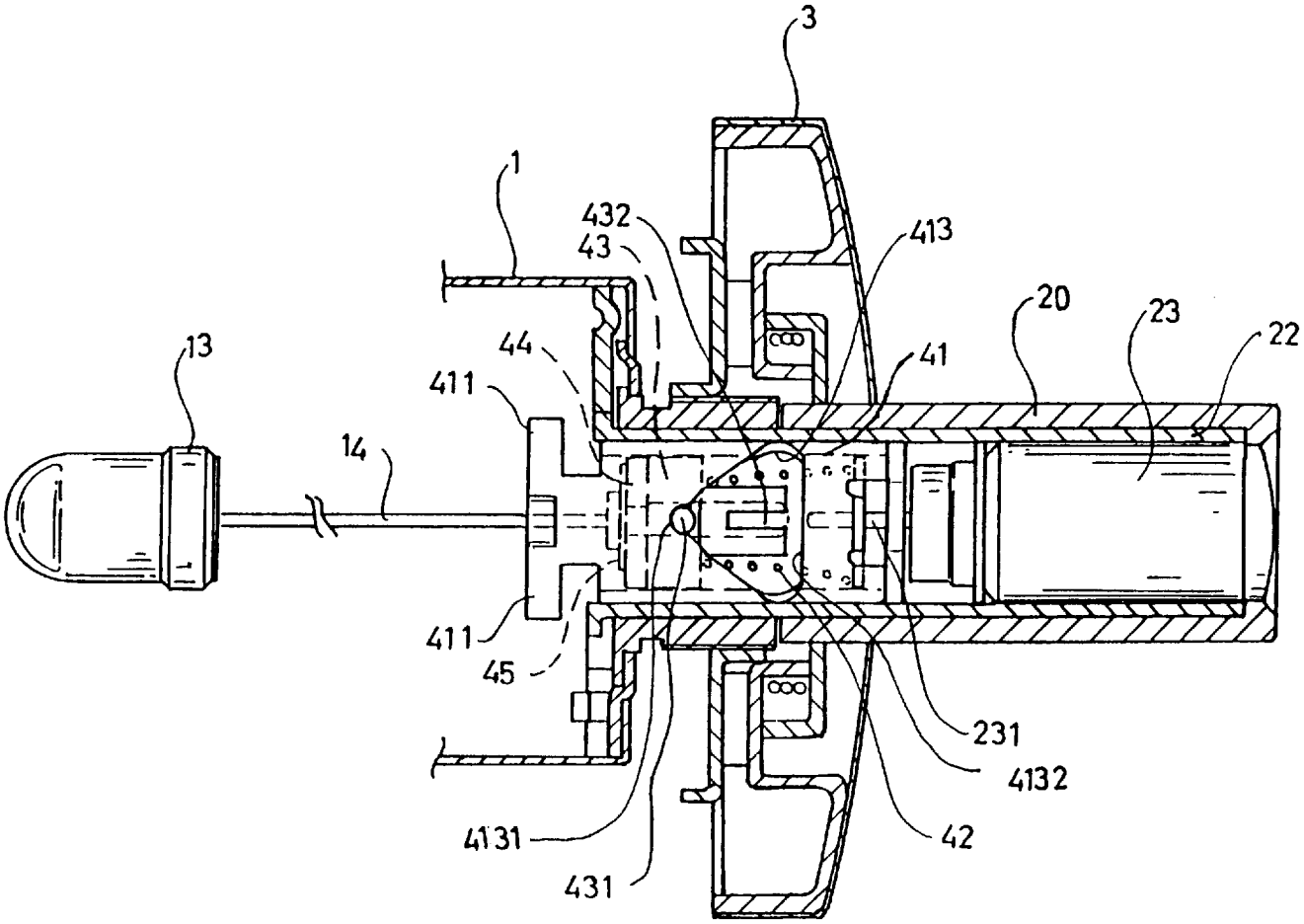
FIG. 3 is a cross-sectional view taken along line 3—3 in FIG. 2.
Figure 6:
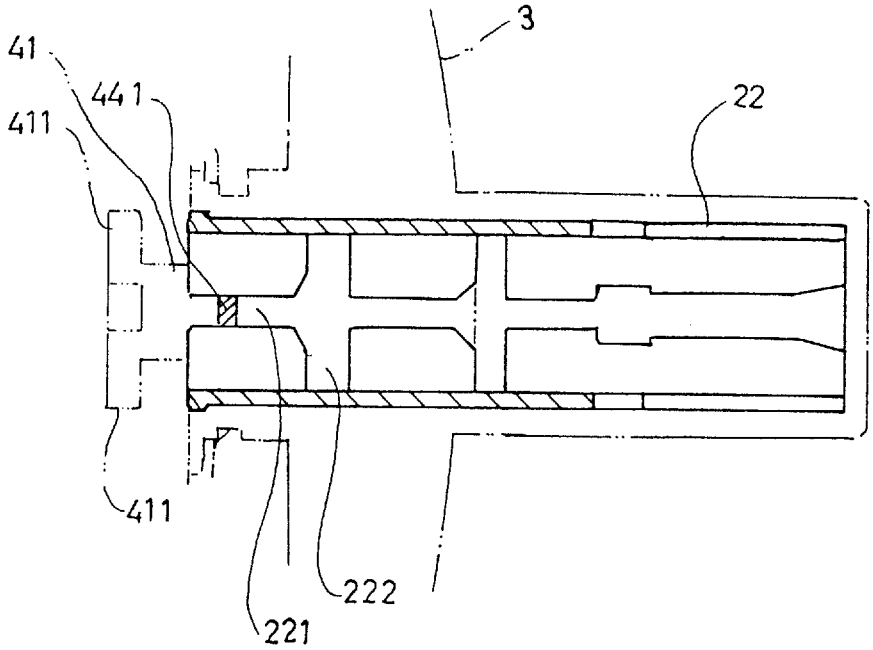
FIG. 6 is a cross-sectional view taken along line 6—6 in FIG. 2.

Referring to FIGS. 2 and 3, the lever lock assembly is in an unlatched position in which the safety bar 14 is not actuated. The inner shaft 43 is biased by the elastic member 42 such that the pin 431 is retained in the end edge of the triangular slot 413 and that the protrusion 441 of the movable plate 44 is retained in the longitudinally extending slot 221 (see FIG. 6). Rotation of the interior lever 12 allows opening of the door which is conventional and therefore not further described. Rotation of the exterior lever 21 causes rotation of the barrel 41, and the ears 411 on the barrel 41 cause the actuator 31 to pull the dead bolt out from the cavity defined in the door jamb, which also allows opening of the door.

Figure 4:
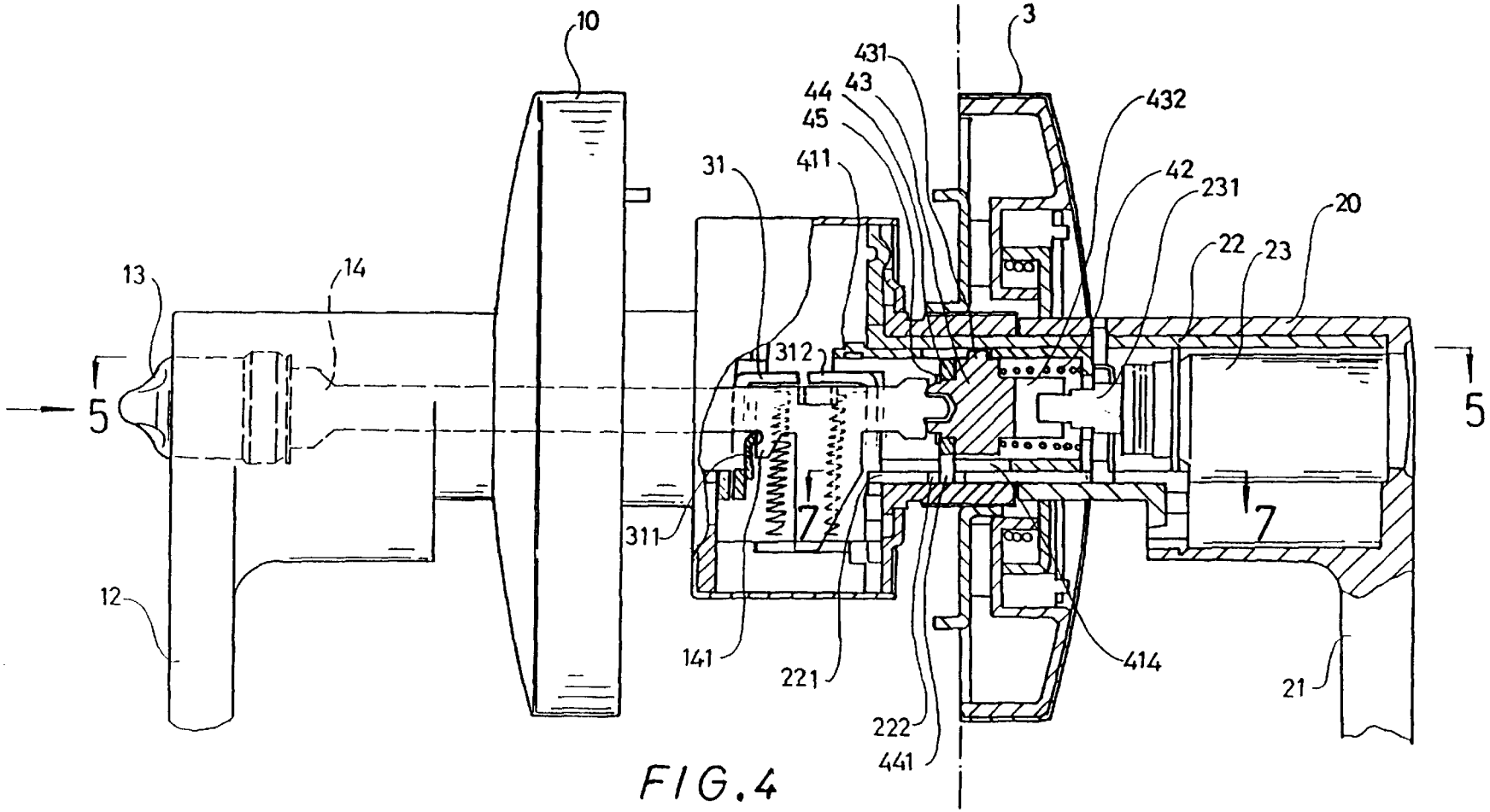
FIG. 4 is a cross-sectional view similar to FIG. 2, wherein the lever lock assembly is in a latched position.
Figure 5:
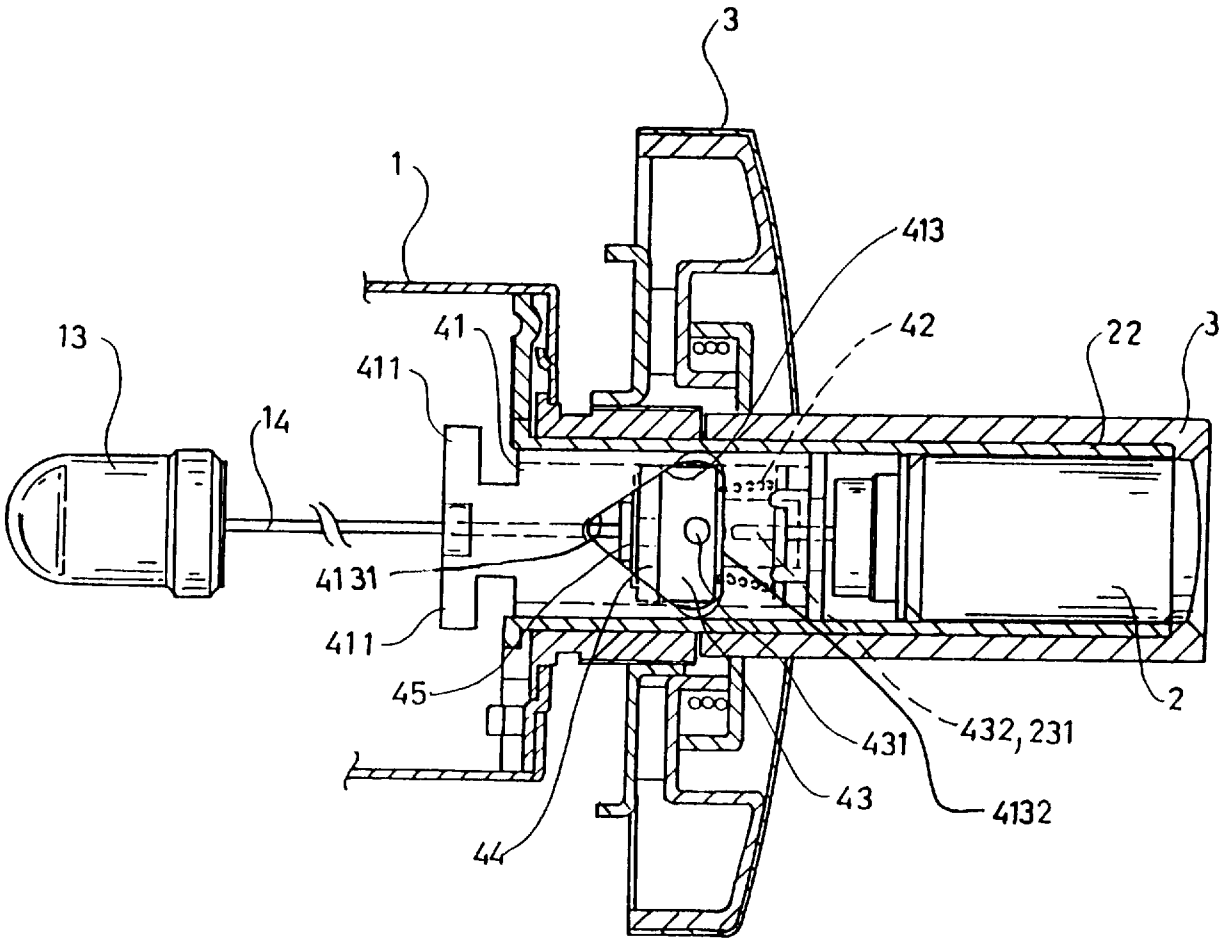
FIG. 5 is a cross-sectional view taken along line 5—5 in FIG. 4.
Figure 7:
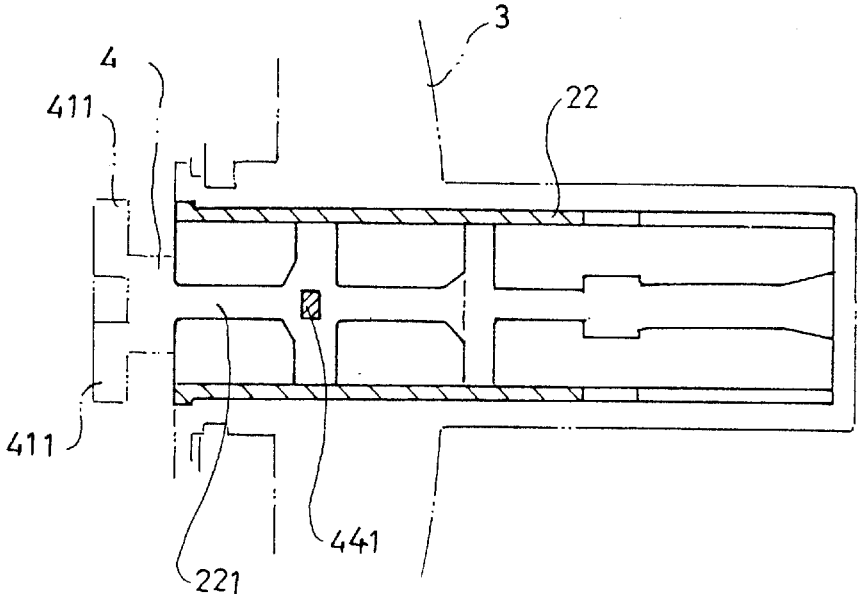
FIG. 7 is a cross-sectional view taken along line 7—7 in FIG. 4.

Referring now to FIGS. 4 and 5, the lock core assembly is in a latched position in which the press button 13 is pressed (cf. FIG. 2) to urge the safety bar 14 to move toward the exterior handle 21 to a position at which the hook 141 is received in the notch 311 of the actuator 31, thereby achieving the required latching function. Meanwhile, the pin 431 is moved to a position retained in the straight section 4132 of the triangular slot 413, while the protrusion 441 of the movable plate 44 is moved to the slot 222 of the exterior spindle 22 (see FIG. 7).

Rotation of the inner lever 12 urges the actuator 31 and returns the safety bar 14 to its original position, thereby allowing opening of the door. Yet, rotation of the exterior lever 21 cannot cause rotation of the barrel 41 as the protrusion 441 of the movable plate 44 is retained in the transverse slot 222 at which the movable plate 44 rotates freely, i.e., the barrel 41 cannot be rotated. By such an arrangement, rotation of the exterior lever 21 causes free rotation and does not activate the actuator 31. It is appreciated that the exterior lever 21 is allowed to rotate through an angle of about 78 degrees.

Still referring to FIGS. 4 and 5, when the lock core assembly is in the locked position, it can be unlatched by rotating the interior lever 12. An alternative way to unlatch the lock assembly is to insert the proper key 24 into a keyway of the lock core assembly 23 and rotate the key 24 through a pre-determined angle. The inner shaft 43 is rotated as the tail piece 231 of the lock core assembly 23 is received in the slot 432 of the inner shaft 43. Nevertheless, the tail piece 231 is rotated through an angle greater than 78 degrees such that the pin 431 of the inner shaft 43 may bear against the end edge of the triangular slot 413 of the barrel 41, thereby causing rotation of the barrel 41. The ears 411, under rotation of the barrel 41, causes the actuator 311 to pull the dead bolt out from the cavity defined in the door jamb, thereby unlatching the lock core assembly.

Accordingly, rotation of the exterior lever is in vain when the lock core assembly is in a locked position, thereby preventing forcibly unlatching by burglars.

Although the invention has been explained in relation to its preferred embodiment, it is to be understood that many other possible modifications and variations can be made without departing from the spirit and scope of the invention as hereinafter claimed.

What is claimed is:

1. A lever lock assembly comprising:

an interior handle assembly comprising an interior handle with an interior lever, an interior spindle attached to the interior handle to rotate therewith, a press button, and a safety bar having a first end connected to and actuatable by the press button and a second end;

an exterior handle assembly including an exterior handle with an exterior lever, an exterior spindle attached to the exterior handle to rotate therewith, and a lock core assembly mounted in the exterior handle and having a tail piece, the exterior spindle further including a first longitudinal slot and a transverse slot intersecting the first longitudinal slot;

a latch assembly adapted to be securely mounted to an interior side of a door to which the lever lock assembly is mounted and including an actuator adapted to cause movement of a dead bolt for locking and unlocking the door, wherein the safety bar engages with the actuator when in a latched position upon depression of the press button, and the safety bar disengages from the actuator when in an unlatched position; and a controlling assembly mounted in the exterior handle and comprising:

a barrel received in the exterior spindle and including two ears projecting outwardly therefrom, the ears causing the safety bar to disengage from the actuator when the barrel is rotated, thereby achieving an unlatching function, the barrel further including a hole in an end wall thereof through which the tail piece of the lock core assembly extends, and a triangular slot with an end edges the barrel further including a second longitudinal slot:

an inner shaft received in the barrel and including a first end adapted for engaging with the tail piece of the lock core assembly, a second end and a pin projecting therefrom and releasably received in the end edge of the triangular slot to rotate therewith when in the unlatched position; an elastic member received in the barrel biasing the inner shaft to engage with the second end of the safety bar and biasing the inner shaft to engage with the barrel to rotate therewith; and a movable plate mounted to the second end of the inner shaft to move therewith along a longitudinal direction of the barrel, the movable plate being rotatable relative to the second end of the inner shaft, the movable plate including a protrusion extending through the second longitudinal slot and slidably received in the first longitudinal slot of the exterior spindle whereby, when in the unlatched position, the protrusion is displaced away from the transverse slot such that the barrel rotates with rotation of the exterior handle, and in the latched position depression of the press button axially moves the inner shaft such that the protrusion is aligned with the transverse slot such that rotation of the exterior handle through a predetermined angle causes the protrusion to move in the transverse slot, without rotation of the barrel.

2. The lever lock assembly according to claim 1, wherein when a key is inserted into the lock core assembly, and the lock core assembly is rotated through an angle greater than the predetermined angle of the exterior handle, the lever lock assembly is unlatched.

3. The lever lock assembly according to claim 1, wherein the second end of the inner shaft includes an annular groove and the movable plate is rotatably retained by a clip in the annular groove in the second end of the inner shaft.

* * * * *

UNITED STATES PATENT AND TRADEMARK OFFICE

CERTIFICATE OF CORRECTION

PATENT NO. : 5,809,815

DATED : September 22, 1998

INVENTOR(S) : Chih-Hsing LEE

It is certified that error appears in the above-identified patent and that said Letters Patent is hereby corrected as shown below:

On the title page, item [73]
Assignee: "Taiwan Fu Hsing" to read --Taiwan Fu Hsing Industry Co., Ltd.--.

Signed and Sealed this

Ninth Day of February, 1999

*Attest:*

*Acting Commissioner of Patents and Trademarks*

*Attesting Officer*